US008806756B2

(12) United States Patent
Kraus et al.

(10) Patent No.: US 8,806,756 B2
(45) Date of Patent: Aug. 19, 2014

(54) ELECTRIC SHAVING APPARATUS

(75) Inventors: Bernhard Kraus, Braunfels (DE); Uwe Schober, Glashuetten (DE); Detlef Gleich, Friedrichsdorf (DE); Thomas Verstege, Frankfurt am Main (DE); Tobias Schwarz, Schmitten, DE (US)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/352,097

(22) Filed: Jan. 12, 2009

(65) Prior Publication Data

US 2009/0165305 A1 Jul. 2, 2009

Related U.S. Application Data

(63) Continuation of application No. PCT/EP2007/004439, filed on May 18, 2007.

(30) Foreign Application Priority Data

Jul. 20, 2006 (DE) ..... 10 2006 034 050

(51) Int. Cl.
*B26B 19/04* (2006.01)
*B26B 19/28* (2006.01)
*B26B 19/38* (2006.01)

(52) U.S. Cl.
USPC ..... 30/43.3; 30/43.7; 30/45

(58) Field of Classification Search
CPC ..... B26B 19/00; B26B 19/02; B26B 19/04; B26B 19/046; B26B 19/048; B26B 19/06; B26B 19/063; B26B 19/28; B26B 19/282; B26B 19/288; B26B 19/38
USPC ..... 30/43.3, 43.7–45
See application file for complete search history.

(56) References Cited

U.S. PATENT DOCUMENTS 3,156,045 A * 11/1964 Godefroy ..... 30/43.3
3,898,732 A * 8/1975 Krainer ..... 30/43.92
4,169,234 A * 9/1979 Yonkers ..... 310/29

(Continued)

FOREIGN PATENT DOCUMENTS

DE 32 13 099 10/1983
DE 39 11 097 11/1990

(Continued)

OTHER PUBLICATIONS

Brain, Marshall. "How Electric Motors Work" Apr. 1, 2000. HowStuffWorks.com. <http://electronics.howstuffworks.com/motor.htm> Nov. 9, 2010.*

*Primary Examiner* — Jason Daniel Prone
(74) *Attorney, Agent, or Firm* — James C. Vago; Jay A. Krebs

(57) ABSTRACT

An electric shaving apparatus including a housing and a shaving head. The shaving head is coupled to the housing by at least one first elastic element and includes at least one first shaving element. The electric shaving apparatus includes in addition an electric motor for generating an oscillatory motion of the shaving head and an oscillatory motion differing therefrom of at least one second shaving element. The electric motor includes two drive components of which a first drive component is adapted to be driven to oscillate relative to a second drive component. One of the drive components is connected to the second shaving element. The second shaving element or a drive part connected thereto is equipped with an elastic connection to the shaving head.

1 Claim, 3 Drawing Sheets

(56) References Cited

U.S. PATENT DOCUMENTS

| | | | | |
|---|---|---|---|---|
| 4,428,117 | A * | 1/1984 | Horii et al. | 30/43.91 |
| 5,245,754 | A * | 9/1993 | Heintke et al. | 30/43.92 |
| 6,357,117 | B1 * | 3/2002 | Eichhorn et al. | 30/43.92 |
| 6,441,517 | B1 * | 8/2002 | Brum et al. | 310/37 |
| 6,559,563 | B1 * | 5/2003 | Shimizu et al. | 310/12.19 |
| 6,933,630 | B2 * | 8/2005 | Kraus et al. | 310/38 |
| 6,991,217 | B2 * | 1/2006 | Shimizu et al. | 251/284 |
| 7,015,602 | B2 * | 3/2006 | Kraus et al. | 310/36 |
| 7,180,254 | B2 * | 2/2007 | Klemm et al. | 318/135 |
| 7,288,863 | B2 * | 10/2007 | Kraus | 310/37 |
| 7,474,065 | B2 * | 1/2009 | Kraus | 318/119 |
| 7,504,751 | B2 * | 3/2009 | Kraus et al. | 310/12.04 |
| 2004/0128834 | A1 * | 7/2004 | Royle | 30/43.92 |
| 2004/0231160 | A1 * | 11/2004 | Shiba et al. | 30/43.92 |
| 2004/0237310 | A1 * | 12/2004 | Shiba et al. | 30/43.92 |
| 2005/0146296 | A1 * | 7/2005 | Klemm et al. | 318/119 |
| 2005/0212633 | A1 * | 9/2005 | Kraus et al. | 200/35 R |
| 2005/0274019 | A1 * | 12/2005 | Inoue et al. | 30/43.7 |
| 2006/0021227 | A1 * | 2/2006 | Shiba et al. | 30/43.92 |
| 2006/0021228 | A1 * | 2/2006 | Shiba et al. | 30/43.92 |
| 2006/0137187 | A1 * | 6/2006 | Fukutani et al. | 30/43.92 |
| 2006/0145547 | A1 * | 7/2006 | Kraus | 318/114 |
| 2006/0175909 | A1 * | 8/2006 | Kraus | 310/12 |
| 2006/0265879 | A1 * | 11/2006 | Sagawa et al. | 30/43.9 |
| 2006/0265880 | A1 * | 11/2006 | Sagawa | 30/43.92 |
| 2007/0056166 | A1 * | 3/2007 | Shiba et al. | 30/44 |
| 2007/0113409 | A1 * | 5/2007 | Schaaf | 30/43.92 |
| 2007/0137043 | A1 * | 6/2007 | Kraus et al. | 30/43.9 |
| 2008/0034591 | A1 * | 2/2008 | Fung | 30/43.92 |
| 2008/0134514 | A1 * | 6/2008 | Iwasaki et al. | 30/43.91 |
| 2008/0134515 | A1 * | 6/2008 | Sato et al. | 30/43.91 |
| 2009/0025229 | A1 * | 1/2009 | Kappes et al. | 30/43.92 |
| 2009/0133263 | A1 * | 5/2009 | Eichhorn et al. | 30/43 |
| 2009/0133266 | A1 * | 5/2009 | Eichhorn et al. | 30/43.7 |
| 2009/0241343 | A1 * | 10/2009 | Yamasaki et al. | 30/43.92 |
| 2011/0094107 | A1 * | 4/2011 | Ring et al. | 30/42 |
| 2012/0005900 | A1 * | 1/2012 | Erndt et al. | 30/43.92 |

FOREIGN PATENT DOCUMENTS

| | | | |
|---|---|---|---|
| DE | 42 16 259 | | 11/1993 |
| DE | 197 36 776 | | 4/1999 |
| DE | 10225024 | A1 * | 12/2003 |
| DE | 10242091 | A1 * | 4/2004 |
| DE | 10242092 | A1 * | 4/2004 |
| DE | 10242093 | A1 * | 4/2004 |
| DE | 10242094 | A1 * | 4/2004 |
| DE | 103 30 978 | | 10/2005 |
| DE | 102006030946 | A1 * | 1/2008 |
| DE | 102008005549 | A1 * | 7/2009 |
| DE | 102008031132 | A1 * | 1/2010 |
| DE | 102008031134 | A1 * | 1/2010 |
| JP | 2005-237598 | | 8/2005 |
| JP | 2007175491 | A * | 7/2007 |
| WO | WO 03103905 | A1 * | 12/2003 |
| WO | WO 2004004112 | A1 * | 1/2004 |
| WO | WO 2004028758 | A1 * | 4/2004 |
| WO | WO 2004028759 | A1 * | 4/2004 |
| WO | WO 2004028760 | A1 * | 4/2004 |
| WO | WO 2005006538 | A1 * | 1/2005 |
| WO | WO 2008003369 | A1 * | 1/2008 |
| WO | WO 2008009322 | A1 * | 1/2008 |

* cited by examiner

ELECTRIC SHAVING APPARATUS

CROSS-REFERENCE TO RELATED APPLICATIONS

This application is a continuation of, and claims priority under 35 U.S.C. 120 from, International Application No. PCT/EP2007/004439, filed May 18, 2007, which claimed priority under 35 U.S.C. 119(a) from German Patent Application DE 10 2006 034 050.7, filed Jul. 20, 2006. Both priority applications are incorporated herein in their entirety.

TECHNICAL FIELD

This invention relates to an electric shaving apparatus.

BACKGROUND

DE-A 103 30 978 discloses an electric shaving apparatus having a linear motor with two oscillators. The shaving head of this shaver is connected to the housing in an oscillatory manner by leaf springs, and the linear motor is suspended within the shaving head. At least one oscillator is connected to at least one shaving element constructed as under cutter in order to sever hairs in combination with an associated second shaving element constructed as shaving foil. Furthermore, oscillatory motions of under cutter and shaving foil of opposite phase are provided.

SUMMARY

One aspect of the invention features an electric shaving apparatus that includes a housing, a shaving head elastically coupled to the housing and including a first shaving element, a second shaving element elastically coupled to the shaving head, and an electric motor arranged in the housing. The electric motor is capable of generating an oscillatory motion of the shaving head and a different oscillatory motion of the second shaving element. The electric motor includes two drive components. One of the drive components is coupled to the second shaving element, and one of the drive components is adapted to be driven to oscillate relative to the other drive component.

The electric motor with its two drive components is arranged in the housing rather than in the interior of the shaving head, which naturally results in a substantial weight reduction and a well balanced weight distribution of the whole shaver. The improved weight distribution of the shaver has a particularly beneficial effect on the handling of the shaving apparatus in cases where shavers are equipped with a pivotal shaving head which, given a substantially reduced weight of the shaving head, is naturally able to follow the skin contours much more easily than a shaving head in which the complete shaver drive mechanism is received. The arrangement of the electric motor in the housing interior facilitates of course also the arrangement and mounting of power and control lines for operating the electric motor. Considering that the elastic connection between the second shaving element or a drive component connected thereto and the shaving head is arranged in the interior of the shaving head, construction and assembly of the shaving head are a particularly simple and economical matter. Only one driven connection is necessary between the housing and the shaving head because the shaving head itself is not driven to oscillate directly by the motor in the housing but by the elastic connection between the shaving element and the shaving head. The oscillatory motions of the two shaving elements (shaving foil and under cutter) of opposite phase are of particular importance for an effective and thorough shave and are described in detail in DE-C 197 36 776 where the movements of the shaving elements in phase opposition to each other are implemented mechanically in a different way and without the use of a linear motor.

According to a preferred embodiment, the electric motor is mounted in the housing by elastic devices. This enables residual vibrations which are not balanced out in the electric motor itself to be isolated relative to the housing. In an embodiment of the electric motor in which the oscillations are particularly well balanced, both drive components are driven to oscillate relative to each other and relative to the housing. This enables the two oscillators of the linear motor to oscillate in phase opposition to one another within the housing and, by correspondingly balancing out the moving masses, makes it possible to provide an electric motor which is optimally balanced with regard to disturbing vibrations.

According to another advantageous embodiment, the elastic connection between the at least second shaving element and the shaving head is constructed to include at least one leaf spring. The spring can be configured in particular in the manner of an oscillatory bridge known in the art and can be mounted in the interior of the shaving head with particular ease and in a cost and space saving manner.

Advantageously, the first elastic element is constructed to include a shaving head support connected to the housing and having at its free end at least part of a pivot bearing for pivotally carrying the shaving head. This pivotal mounting provides a particularly flexible shaving unit which conforms itself to the contours to be shaved automatically. As such, it has proven to be particularly advantageous to pivotally mount the shaving head about an axis extending parallel to the longitudinal axis of the shaving elements.

Regardless of whether the pivotal or the fixed type of shaving head is employed, it is advantageous for the electric motor to include a drive pin engaging an oscillatory plate mounted in the shaving head, because such a drive pin can be sealed reliably with relatively little outlay, which is conducive to the construction of a watertight and therefore easy-to-clean housing.

If the oscillatory system formed by the shaving head itself and its elastic mounting on the housing is excited by the second shaving element above its resonant frequency, that is, beyond resonance, it is always ensured that the shaving head and hence the shaving foils secured thereto move in phase opposition to the driven under cutters, which eliminates the need to employ further particular devices. Both the movement of the under cutters and the movement of opposite phase of the shaving head with the shaving foils secured thereto are implemented only by one moving connection between the handpiece and the shaving head. This is accomplished in that the actively driven shaving head, rather than being operated directly by the motor in the handpiece, is operated by the elastic connection between the shaving head and the driven under cutters, with the shaving head support itself being constructed to include a resilient element. In contrast to the use of direct-current motors, the use of a linear motor as drive enables very high operating frequencies to be used, and yet friction and noise are avoided in the drive mechanism of the shaving parts because of the absence of gearing, levers or other transmission members, using instead springs, in particular leaf springs, for establishing all the driving connections.

Other objects, features, advantages and application options will become apparent from the subsequent description of the embodiments. It will be appreciated that any feature described or represented by illustration, when used singularly or in any combination, forms the subject matter of the present disclosure.

DETAILED DESCRIPTION

Figure 1:
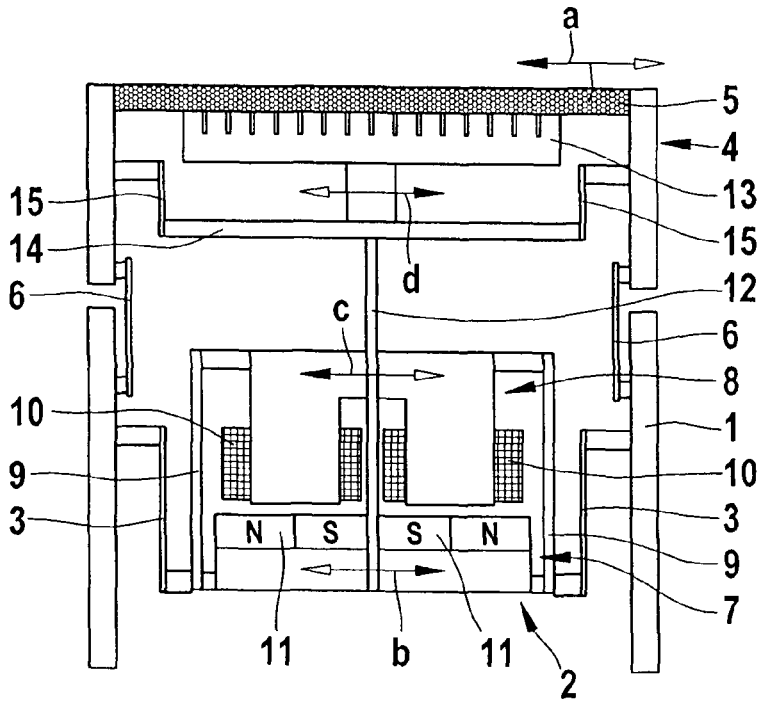
FIG. 1 is a schematic view of a dry shaving apparatus.

The shaving apparatus illustrated schematically in FIG. 1 includes a housing 1 to be held in a user's hand and accommodating an electric motor 2 and its energy supply, not shown, in the form of a rechargeable battery and/or a power supply unit, as well as the complete motor control, switches, etc. The electric motor 2 is elastically mounted in the housing 1 by a motor suspension 3 constructed to include a plurality of leaf springs, in order to prevent the transmission of motor vibrations to the housing 1.

The shaving head 4 which mounts at least one shaving foil 5, which represents a first shaving element, is connected to the housing 1 in an oscillatory fashion by means of two shaving head supports 6. The leaf-spring type shaving head supports 6 allow a transverse oscillation of the shaving head 4 and with it of the shaving foil 5 within the plane of projection, as indicated by double arrow a.

The electric motor 2 includes a first oscillator 7 and a second oscillator 8 which are coupled to one another by a resonant spring 9. The second oscillator 8 is U-shaped in cross-section so that two iron cores are formed around each of which a coil 10 is wound. The coils 10 are connected to electronic circuitries, not shown, which are disposed in the interior of the housing 1 and are configured to control the current supply to the coils 10.

On its side close to the second oscillator and hence to the coils 10, the first oscillator 7 includes one or a plurality of permanent magnets 11 the north and south magnetic poles of which are shown in FIG. 1.

The first oscillator 7 mounts a drive pin 12 which engages an oscillatory plate 14 on which one or a plurality of under cutters 13 are fastened. The under cutters 13 cooperate with one or a plurality of shaving foils 5 so that cooperating cutting elements are able to cut hairs that penetrate the perforations in the shaving foils 5. To be able to set the shaving head 4 itself into oscillations, the oscillatory plate 14 has fastened to its right and left hand sides one end of a leaf spring 15 whose other end is secured to the shaving head 4.

With the shaving apparatus in the operating mode, the coils 10 of the second oscillator are supplied with current and generate a magnetic field which acts on the permanent magnets 11 of the first oscillator. This causes the first oscillator 7 to be displaced sideways relative to the second oscillator 8. By controlling the flow of current to the coils 10 periodically as known in the art, the two oscillators 7, 8 are displaced in mutually opposite directions in alternation and returned to their initial positions by the restoring forces of the resonant springs 9. In this manner a linear oscillatory motion is imposed on the oscillators. The oscillatory motions of the oscillators 7, 8 of opposite phase are indicated by associated double arrows b and c, respectively. Because both oscillators move in phase opposition to each other and none of the oscillators 7, 8 is connected fast with the housing 1, the vibrations resulting from the moved masses are balanced out automatically. This applies in particular when the mass centers of gravity of the oscillators 7, 8 involved and the components firmly connected to them and moved along with them move on a common straight line.

The movement of the oscillator 7 is transmitted by the drive pin 12 to the oscillatory plate 14 and onwards to the under cutter 13. At the same time, the shaving head 4 is excited to oscillate owing to its connection to the oscillatory plate 14 via the leaf springs 15. Considering that excitation of the shaving head 4 is beyond resonance, i.e., the excitation frequency via the drive pin 12 lies substantially above the resonant frequency of the oscillatory system comprised of shaving head 4 as mass and leaf spring 15 as spring, the oscillatory motion of the shaving head as indicated by the double arrow a is out of phase with the oscillatory motion of the under cutter 13 as indicated by the double arrow d. The phase shift actually developing during operation depends, among other factors, on the friction occurring between the under cutter 13 and the shaving foil 5, which friction is in turn dependent on the contact pressure applied by the user. Ideally, the phase shift angle amounts to 180°, so that the shaving foil 5 moves precisely in phase opposition to the movement of the under cutter 13.

Figure 2:
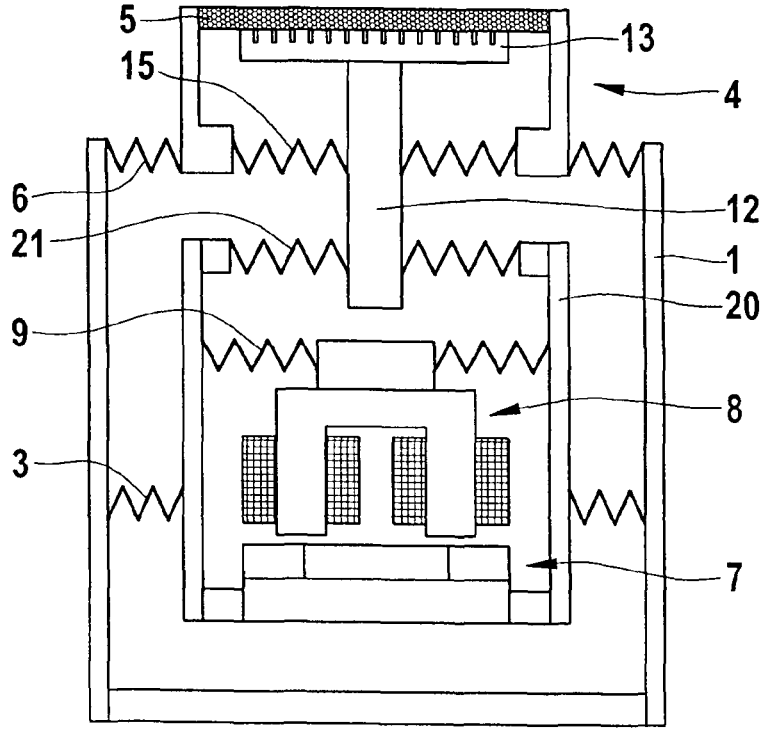
FIG. 2 is a mechanical substitute for the kinematics of FIG. 1.

FIG. 2 is another representation of the kinematics described in the foregoing, showing all the moving masses and elasticities. Reference numeral 3 designates the motor's elastic suspension which couples the oscillatory frame 20 to the housing 1. The oscillatory frame 20 is connected fast with the first oscillator 7. The second oscillator 8 takes support upon the oscillatory frame 20 through the resonant springs 9. In view of the fact that the drive pin 12 and also the oscillatory frame 20 exhibit a certain elasticity, it is shown as spring element 21 in the drawing. The elastic shaving head support 6 is also drawn as a spring element which connects the housing 1 to the shaving head 4. The leaf spring 15 connects the drive pin carrying the under cutter 13 to the shaving head 4. As a result of the elasticity of the spring element 21 representing the oscillatory frame 20 and the drive pin 12 secured thereto, this drive element acts as a relatively stiff spring which is the reason why the amplitude of the under cutter 13 is greater than the amplitude of oscillation of the first oscillator 7, as will be explained later with reference to FIG. 4.

Figure 3:
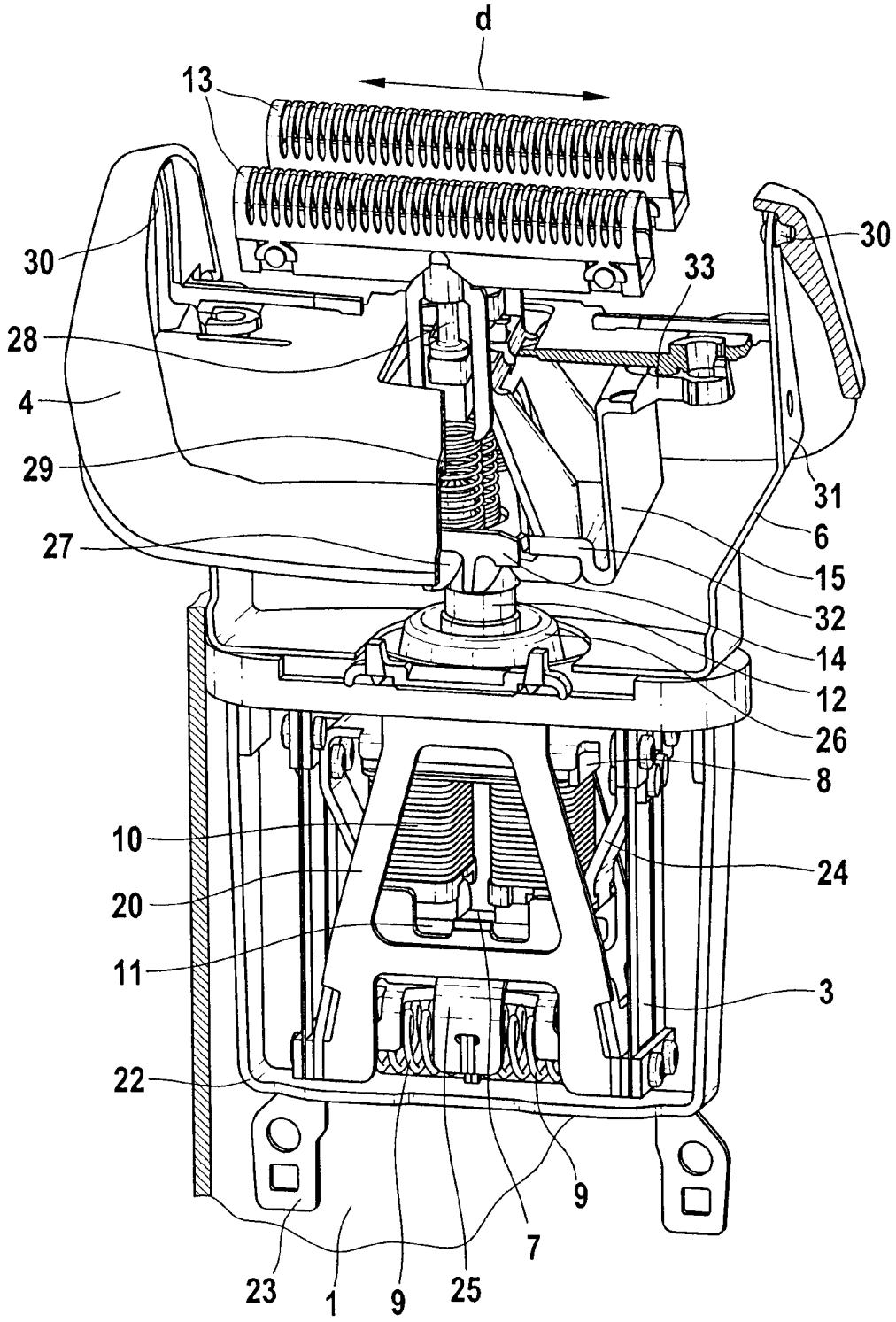
FIG. 3 is a perspective view of an electric shaving apparatus.

FIG. 3 shows in a perspective representation and with parts of the housing 1 broken away the upper part of a dry shaver, in which the shaving foil 5 which is connected to the shaving head 4 has been omitted on purpose for reasons of clarity of the illustration. In this embodiment, the electric motor 2 is elastically suspended in a motor mount 22 connected fast to the housing by the motor suspension 3. The motor mount includes a box-shaped frame having a plurality of fastening tabs 23 for connecting it to the housing 1. The motor mount 22 is suited to a complete preassembly of the entire electric motor 2 including motor suspension 3, oscillatory frame 20 and drive pin 12. While the first oscillator 7 carrying the permanent magnets 11 is connected fast with the oscillatory frame 20, the second oscillator 8 which carries the coils 10 is arranged in an auxiliary frame 24 which is coupled to the oscillatory frame 20 in a manner capable of oscillation. The second oscillator 8 is connected to a coupling element 25 constructed as a molded sheet-metal part, which coupling element extends downwardly, ending in the region of the resonant springs 9. The two resonant springs 9 are configured as helical springs bearing with their end sections, which point towards the center, against the coupling element 25 and with their outwardly pointing ends against the oscillatory frame 20. This enables the first oscillator 7 and the second oscillator 8 to be driven to oscillate in phase opposition to each other by suitable control of the flow of current to the coils 10. Leaf springs of low flexural resistance which extend parallel to the motor suspension 3 serve to guide the auxiliary frame 24 parallel to the oscillatory frame 20. The oscillatory frame 20 carries at its upper end the drive pin 12 which is guided out of the housing 1 and sealed by a cup seal 26. The upwardly pointing end of the drive pin 12 engages a transverse groove 27 in the oscillatory plate 14 which is guided for longitudinal displacement in the shaving head 4. Arranged on the oscillatory plate 14 are mounting bolts 28 which connect the oscillatory plate 14 to the under cutters 13. Compression springs 29 surrounding the mounting bolts 28 carry the shaving units, each of which includes an under cutter 13 and an associated shaving foil 5, so as to be retractable in the shaving head 4.

The shaving head 4 itself is connected to the housing 1 by a fork-shaped shaving head support 6, with the connection between the shaving head 4 and the shaving head support 6 being established by pivot joints 30 arranged at the free ends of the two arms 31. As a result, the shaving head 4 is pivotally connected to the housing about an axis of rotation extending parallel to the direction of oscillation—see double arrow d—of the under cutters 13. The arms 31 are of the leaf spring type and hence flexurally elastic with respect to forces acting parallel to the longitudinal axis of the under cutters 13 or their direction of oscillation d. In consequence, the shaving head 4 and the arms 31 represent an oscillatory system which is excited by the leaf spring 15 whose lower end section 32 is connected to the oscillatory plate 14 while its upper end section 33 is secured to the housing of the shaving head 4.

Figure 4:
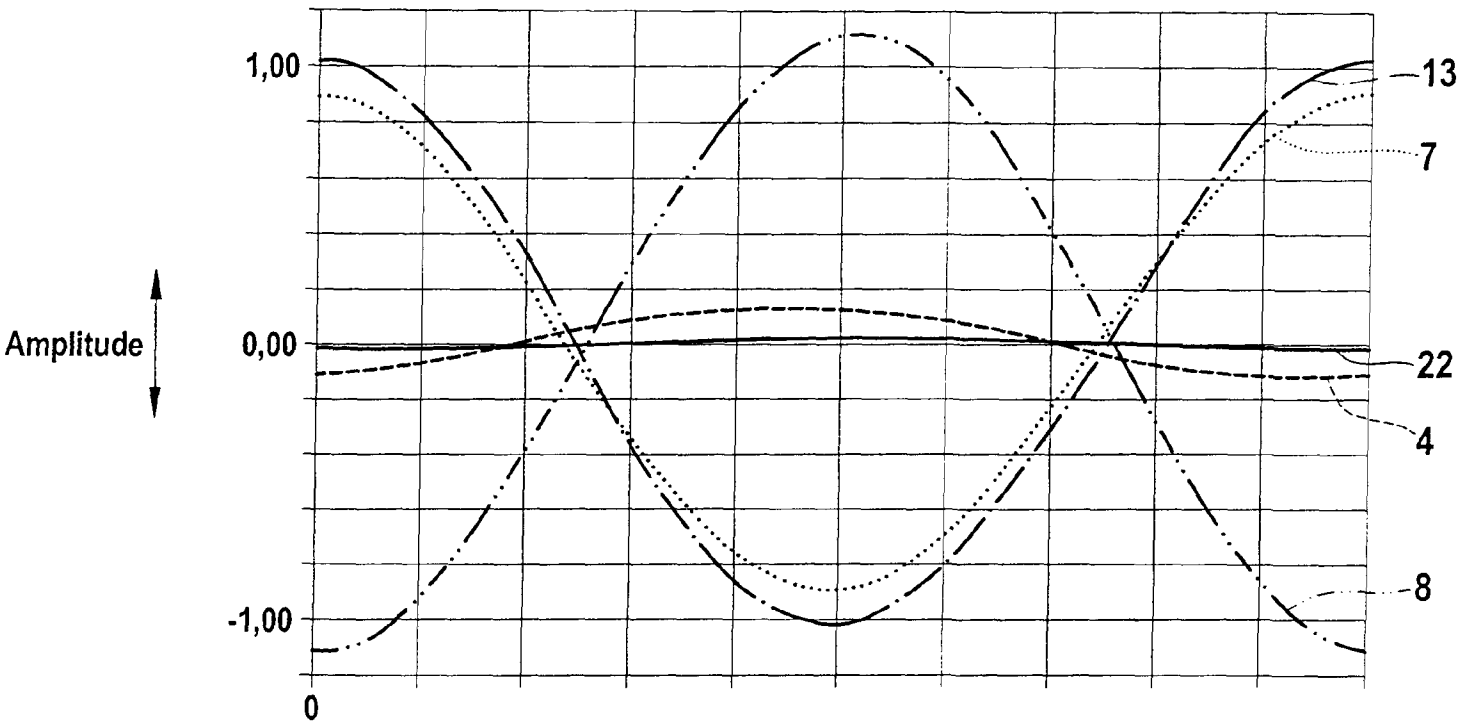
FIG. 4 is a graph showing the curve shapes of the oscillations of individual shaver components of the shaving apparatus of FIG. 3.

FIG. 4 is a graph showing the curve shapes of the oscillations of the individual elements driven to oscillate, which include the under cutter 13, the first oscillator 7, the shaving head 4 and the second oscillator 8. In addition, it shows the oscillation which can be measured on the motor mount 22 and which corresponds to the vibration in the housing 1. As is clearly identifiable, the oscillation of the first oscillator 7 is in phase opposition to that of the second oscillator 8, with the amplitude of the second oscillator 8 carrying the coils 10 being somewhat larger than the amplitude of the first oscillator 7 carrying the magnet arrangement. Because of a certain elasticity of the oscillatory frame 20 and the drive pin 12, the amplitude of the under cutter 13 is somewhat larger than that of the first oscillator 7 connected to it. Due to the configuration of the leaf spring 15, the amplitude of the shaving head 4 amounts to about 10% of the amplitude of the under cutter or oscillatory plate and is in phase opposition to the oscillation of the oscillatory plate 14, because the excitation frequency by the oscillatory plate 14 is above the resonant frequency of the oscillatory system comprised of the mass of the shaving head 4 and the leaf spring 15 acting as spring.

Owing to the phase opposition of the movements of the different masses, the vibration transmitted to the housing 1 or the motor mount 22 is nearly zero, as becomes apparent from the shape of this oscillation curve.

What is claimed is:

1. An electric shaving apparatus comprising:

a housing (1) accommodating an electric motor (2);

a shaving head (4) which mounts at least one perforated shaving foil (5) secured to said shaving head as a first shaving element;

a second shaving element comprising under cutters (13) which cooperate with said foil to cut hairs that penetrate said foil;

wherein said shaving head is connected to the housing in an oscillatory fashion by two leaf spring shaving head supports (6) that allow a transverse oscillation of the shaving head and with it of the shaving foil;

wherein the electric motor includes a first oscillator (7) and a second oscillator (8) which are coupled to one another by a resonant spring (9);

wherein said first oscillator includes one or a plurality of permanent magnets (11);

wherein said second oscillator is U-shaped in cross-section to form two iron cores; around each of which a coil (10) is wound;

said first oscillator mounting a drive pin (12) which engages an oscillatory plate (14) on which one or a plurality of said under cutters are fastened;

wherein the oscillatory plate has fastened to its right and left hand sides one end of a leaf spring (15) whose other end is secured to the shaving head; and whereby movement of the first oscillator is transmitted by the drive pin to the oscillatory plate and onwards to the under cutters while, at the same time, the shaving head is excited to oscillate owing to its connection to the oscillatory plate via the leaf spring (15).

* * * * *